United States Patent [19]

Hall

[11] Patent Number: 4,489,715

[45] Date of Patent: Dec. 25, 1984

[54] PORTABLE CERVICAL TRACTION APPARATUS

[76] Inventor: Donald C. Hall, 13711 Jefferson St., Westminster, Calif. 92683

[21] Appl. No.: 408,225

[22] Filed: Aug. 16, 1982

[51] Int. Cl.[3] ..... A61H 1/02

[52] U.S. Cl. ..... 128/75; 128/68

[58] Field of Search ..... 128/69, 71, 75, 76 R, 128/84 R, 84 C, 87 R, 87 B; 272/118

[56] References Cited

U.S. PATENT DOCUMENTS

| | | | |
|---|---|---|---|
| 848,272 | 3/1907 | Thornley | 128/84 R X |
| 3,009,461 | 11/1961 | Collins | 128/75 |
| 3,306,611 | 2/1967 | Gaul | 272/118 |
| 3,871,366 | 3/1975 | Cotrel | 128/75 |
| 4,220,147 | 9/1980 | Allen | 128/87 B X |

*Primary Examiner*—Richard J. Apley
*Assistant Examiner*—Chris Coppens
*Attorney, Agent, or Firm*—Edward E. Roberts

[57] ABSTRACT

Portable cervical traction apparatus including a generally planar generally rigid platform of radiolucent material attachable to a turning frame for use with the conventional traction arrangement thereof, and a portable traction unit attachable to the platform without interfering with the conventional traction. The unit has a framework configured for straddling the conventional traction cord while attaching the unit to the platform in the space between the patient's head and the adjacent end of the platform. The weight carrying assembly is movably mounted in the lower part of the unit and includes a split weight carrying plate arrangement for straddling the cord. A compound pulley arrangement enables the applying of tension to the cord of the unit with one end attached to the traction bracket and the other end fixed relative to the framework, after which the conventional traction can be removed and the patient transported on the platform, in traction, for further diagnosis or treatment, the size of the unit being compact for enabling passage through the opening of computerized tomography apparatus.

25 Claims, 8 Drawing Figures

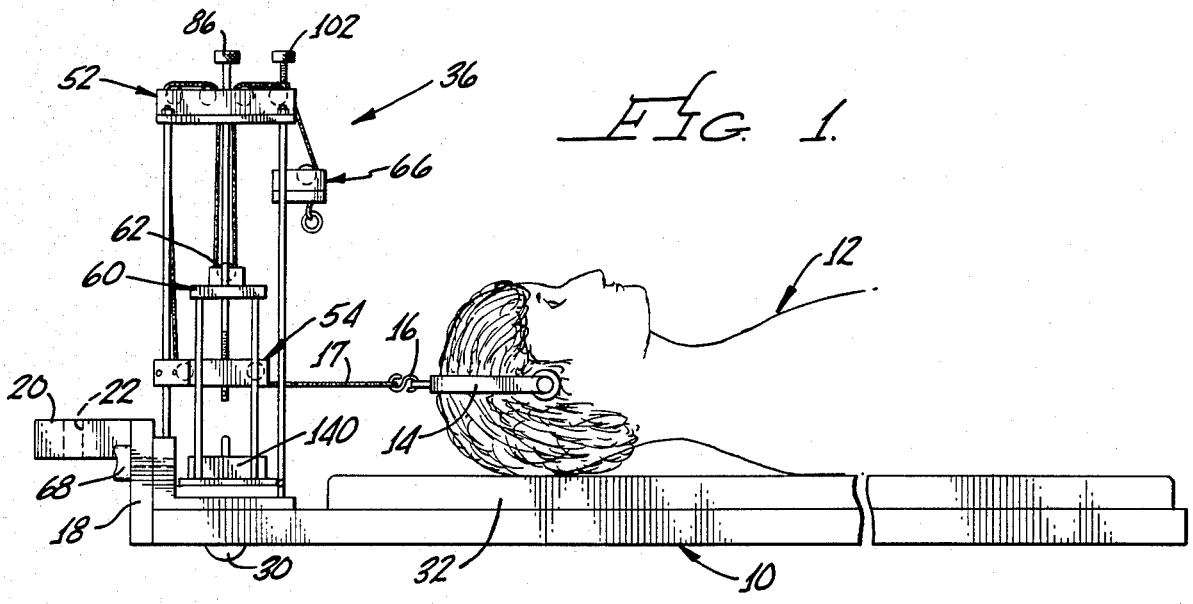
FIG. 1.
FIG. 2.
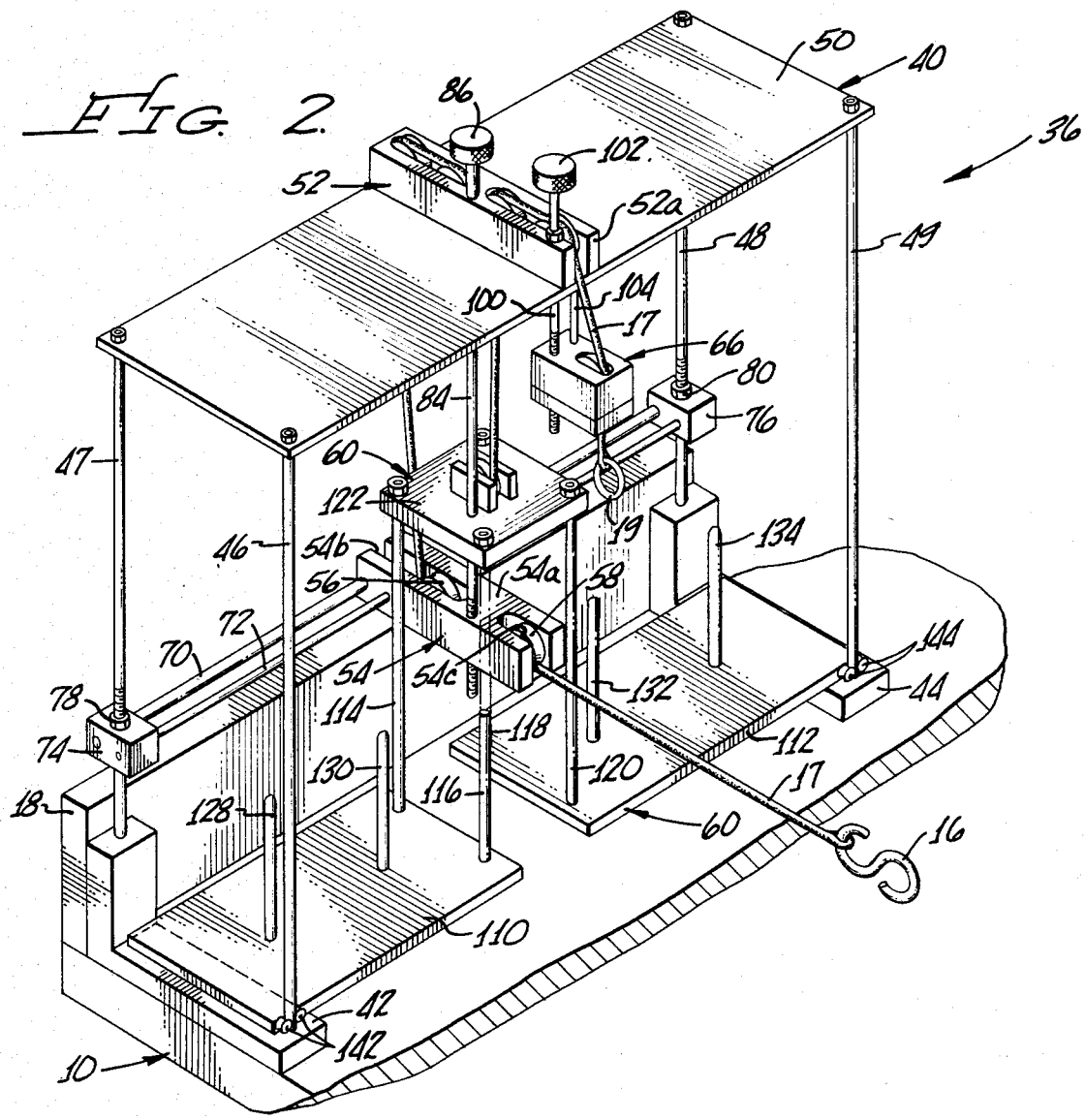

FIG. 5.
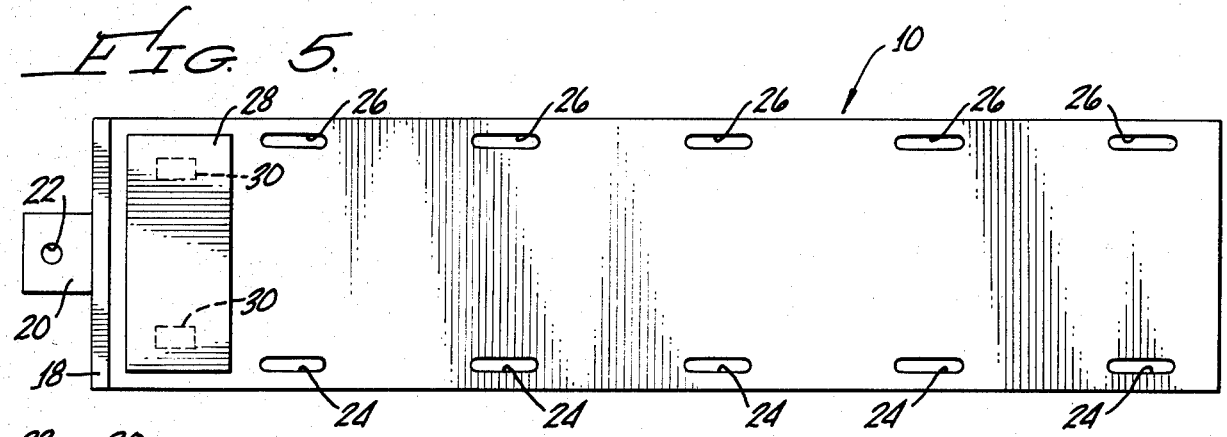
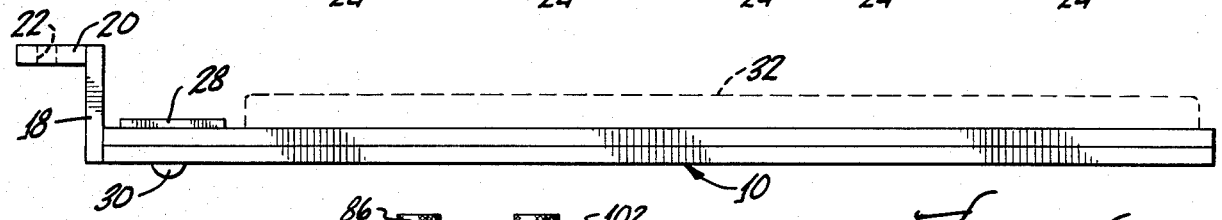
FIG. 6.
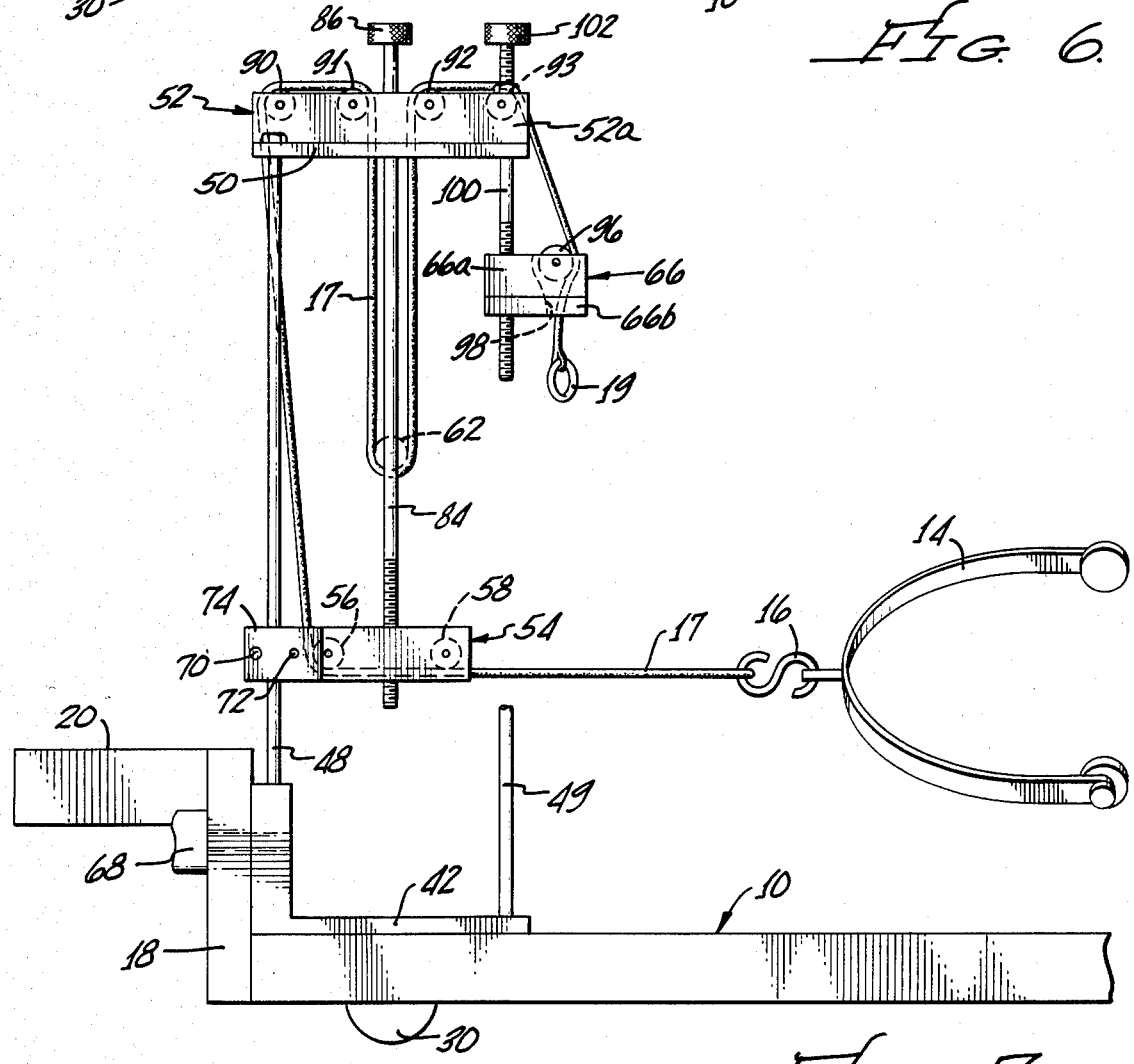
FIG. 7.

PORTABLE CERVICAL TRACTION APPARATUS

BACKGROUND OF THE INVENTION

The background of the invention will be discussed in two parts:

1. Field of the Invention

This invention relates to traction apparatus, and more particularly to a portable cervical traction apparatus and platform for use therewith.

2. Description of the Prior Art

In cases involving injury to the spine or neck, a primary necessity in emergency treatment and subsequent medical treatment is that the patient be immobilized in the region of the injury. Devices and apparatus have been developed for doing this, however most of such devices and apparatus have concentrated on the emergency treatment and transportation of the patient.

One such device is shown and described in U.S. Pat. No. 2,141,100 issued Dec. 20, 1938 to Warden, entitled "Splint Stretcher Board". The device is essentially a rigid generally planar body member having casters or rollers, with handle means.

Another litter device is shown and described in U.S. Pat. No. 2,516,925, issued Aug. 1, 1950 to Shaw, entitled "Patient Supporting Means". The litter is a collapsible pole litter having traction and countertraction means at opposite ends thereof, these means being in the form of a rotatable rod member operable through a form of ratchet device to apply tension, as needed.

In U.S. Pat. No. 3,724,453, issued Apr. 3, 1973 to Dixon et al, entitled "Splints", there is shown a device having a generally rigid board member, to which is attached a plurality of strap members to form a harness for immobilizing the head portion of an injured person along with the neck for suspected neck injury situations.

An upper torso board is shown and described in U.S. Pat. No. 3,469,268, issued to Phillips on Sept. 30, 1969, entitled "Fracture Board". The board is configured for abutting the back neck and head of the person, with a neck support member, and strap means for fixedly positioning the patient relative to the board.

Another such upper torso device is shown in U.S. Pat. No. 4,034,748, issued to Winner, on July 12, 1977, entitled "Spinal Restraint Device". This device includes means abutting the sides of the head about which strap members extend for engaging the forehead of the patient.

A "Universal Short Spine Board" is shown in U.S. Pat. No. 4,143,654, issued to Sherman on Mar. 13, 1979, the device including a board having attached thereto a conforming vent for securing the patient relative to the board.

U.S. Pat. No. 4,267,830, issued to Vick on May 19, 1981 entitled "Combination Spine Board and Head Stabilizer" shows a device having a removable head stabilizer for immobilizing the head and neck area of a patient prior to extrication from a vehicle or the like.

Such prior art devices are primarily intended for use in rendering emergency treatment at the scene of an accident, such as a vehicular accident, where it is preferable, when spinal or cervical injuries are suspected, to immobilize the patient, usually prior to removal from the vehicle. Such devices are therefore temporary as far as use is concerned. At the medical facility, the patient is examined, x-rayed, and, if necessary, placed in a more permanent arrangement where traction is required.

Installations at hospital facilities for traction generally include a rigid platform on which the patent is placed, and secured, with traction apparatus then attached to the patient. For cervical situations, a device such as a Gardner Wells tongs may be attached to the head of the patient, with a traction cord secured to the tongs, the cord then being passed over a pulley, with the other end of the cord being attached to suitable traction weights. In such arrangements, the pulley is secured to a point fixed relative to the platform. This then applies tension to the head of the patient in accordance with the amount of weight.

However, for further diagnostic treatment, such as utilizing a computerized tomography (C.T.scan) apparatus, the patient must be removed from the traction for transportation and passing through the C.T.scan opening, which is approximately two feet in diameter. For cervical trauma patients, treatment usually includes placing the patient in continuous skeletal traction. Oftentimes the patient is placed in a "turning frame", comprised of a posterior platform and an anterior platform, the posterior platform allowing the patient to be supported in a supine position and the anterior platform providing support for the patient in a prone position while maintaining cervical traction and alignment.

The difficulty is maintaining traction and body alignment while transferring the patient from the turning frame. In the case of computerized tomography, the patient must then be lifted onto a "scanner platform", which resembles an x-ray table. At the present time, the method used entails removing the traction weights, and lifting the patient, by hand, onto the scanner platform. During this procedure, a physician usually lifts the patient's head and applies traction to the neck, manually. Once the scanning operation is performed, the procedure is then repeated, with manual traction again being applied until permanent traction is arranged.

Turning frames of conventional design utilize tubular steel or aluminum for the posterior platform on which the patient is placed. For that reason, it is not effective to simply leave the patient attached to the posterior platform while passing the patient through the C.T.scanner. The metallic content of the platform is radio-opaque, and results in tremendous aberrations in the data obtained by the scanner. Consequently unnecessary moving of the patient, as described, is required.

It is an object of the present invention to provide a new and improved cervical traction apparatus.

It is another object of the present invention to provide a new and improved apparatus which includes a radiolucent platform compatible for use with conventional turning frames.

It is a further object of the present invention to provide a new and improved portable traction apparatus of compact size.

It is still another object of the present invention to provide a new and improved apparatus and method for transferring a patient from conventional traction to portable traction.

SUMMARY OF THE INVENTION

The foregoing and other objects of the invention are accomplished by providing a posterior platform of radiolucent material, such as wood, the platform having a transversely extending support fastener at the head end thereof, with a mounting block secured thereto for attachment to a turning frame assembly. During treatment with the turning frame conventional traction is utilized. For transfer of the patient, a portable traction unit is placed on the platform between the head of the patient and the support fastener, and secured thereto. The portable traction unit has a traction weight assembly configured for non-interference with the conventional traction arrangement. The portable traction unit includes a support frame having an auxiliary pulley assembly positioned on the top thereof and generally centrally relative thereto. A main pulley assembly is secured to the frame in a manner to allow vertical and lateral adjustment. A traction weight carrier assembly is positioned within the frame for vertical movement, this assembly including alignment wheels coacting with rods on the support frame for maintaining alignment of the weight assembly during use. The weight assembly is configured to straddle the traction rope of the conventional traction arrangement to permit use of direct traction until such time as the changeover to portable traction is effected. The upper end of the traction weight carrier assembly includes a pulley member. A fixing block assembly is secured to the support frame, the fixing block assembly including a pulley and being vertically adjustable.

Traction cord is secured at one end thereof to the head traction device and threaded about the main pulley through auxiliary pulleys, through the traction weight pulley, through other auxiliary pulleys, and thence through the fixing block pulley, the free end of the cord having a ring attached thereto. A supplemental cord attached to the ring is then secured to the cord of the conventional traction apparatus and tension is applied. The fixing block is then adjusted downward until contact with the ring is effected, at which time the portable traction unit is operable and the direct traction can be removed.

Other objects, features and advantages of the invention will become apparent from a reading of the specification when taken in conjunction with the drawings, in which like reference numerals refer to like elements in the several views.

BRIEF DESCRIPTION OF THE DRAWINGS

FIG. 1 is a side elevational view, partially diagrammatic, of the cervical traction apparatus according to the invention;

FIG. 2 is a perspective view of the portable traction apparatus according to the invention, illustrating, in part, the platform;

FIG. 5 is a plane view of the platform in the apparatus of FIG. 1;

FIG. 6 is a side elevational view of the platform of FIG. 5;

FIG. 7 is a side view, partially diagrammatic, of the portable traction apparatus of FIG. 2 as viewed generally along line 7—7 thereof.

DESCRIPTION OF THE PREFERRED EMBODIMENT

Figure 3:
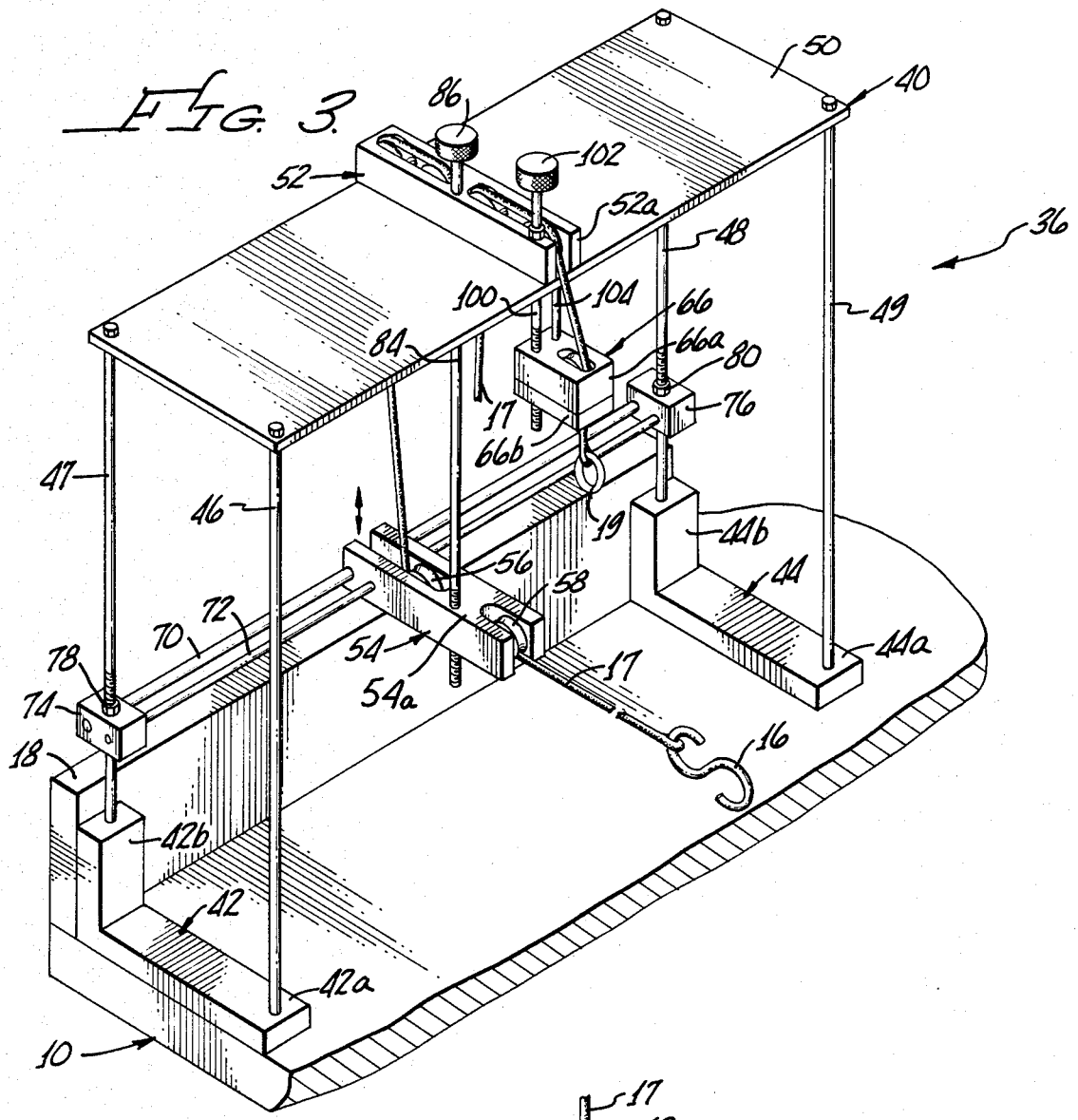
FIG. 3 is a perspective view of the portable traction apparatus similar to FIG. 2, with the traction weight carrier assembly removed.

Referring now to the drawings, and particularly to FIG. 1, there is shown the traction apparatus according to the invention, the apparatus including a platform, generally designated 10, on which is a patient 12 (only partially shown), the patient 12 having attached to the skull thereof a suitable traction device 14. The device 14 may be a generally U-shaped bracket known as a Gardner Wells tongs, which has means for attaching to the skull in fixed relation, with the mid portion of the tongs being configured for attachment to an S-hook 16. In conventional traction systems, the S-hook 16 would receive one end of a traction cord securely, with the cord then passing through a pulley and the other end thereof secured to a suitable traction weight operating under the force of gravity. The patient would be suitably secured to the platform such as by means of straps or the like (not shown).

In accordance with the present invention, the platform 10 is made of a radiolucent material, such as wood or the like. The head end of the platform 10 has secured thereto a generally perpendicularly oriented support plate 18 which is preferably formed of a structurally sound material, such as steel or aluminum. As can be seen also in FIGS. 5 and 6, the platform 10 is generally planar and rigid and includes means for attaching to a turning frame, the means being a mounting block 20, formed of aluminum or the like, extending outwardly from the rear surface of the support plate 18 at the approximate middle thereof, with the mounting block 20 having an aperture 22 therethrough for convenient assembly to the turning frame.

A plurality of aligned handle openings 24 and 26 are formed (FIG. 5) along the edges of the platform 10 for facilitating moving of the platform 10 as needed, as well as for enabling the positioning of straps therethrough, as required. A structural plate 28 may be secured to the platform 10 adjacent the head end thereof, the plate 28 being generally rectangular and positioned transversely across the platform 10. Beneath the plate 28, a pair of openings (not shown) are formed through the platform 10, with the openings having suitably attached therein a pair of rollers 30. The rollers 30 facilitate use of the platform 10 with computerized tomography apparatus through which the platform 10 passes, the procedure requiring incremental movement of the patient for each scan. As shown in dotted lines in FIG. 6, and in solid lines in FIG. 1 the platform 10 is preferably provided with a suitable pad 32, on which the patient 12 lies.

Referring again to FIG. 1, in accordance with the present invention, secured to the platform 10 in the space intermediate the head of the patient 12 and the support plate 18 is a portable traction unit, generally designated 36, which is compact and efficient and enables the application of traction while the patient in undergoing diagnostic evaluation or treatment, such as with computerized tomography or hyperbaric oxygen therapy, both systems having rather small openings through which the platform passes. The portable traction unit 36 has dimensions of about five inches deep, about seventeen inches wide and about fourteen inches high.

By referring also to FIGS. 2 through 4, the unit 36 will now be described according to major assemblies, initially, and then a description of the assemblies. In the drawings, in many instances, for the sake of clarity, some fasteners have been omitted. The unit 36 includes a structural framework, generally designated 40, having a pair of L-shaped mounting blocks 42 and 44 secured to rod members 46–49, which extend upwardly to support a plate 50 at the upper ends thereof. Mounted on plate 50 at the approximate middle thereof is an auxiliary pulley block assembly 52. Extending across the middle of the framework 40 is a main pulley block assembly 54 suitably supported, this assembly having attached thereto pulleys 56 and 58. A traction weight assembly 60 (see particularly FIG. 4) is suitably supported within the framework 40, the weight assembly 60 having a pulley 62 attached thereto at the approximate midpoint thereof. The final assembly is a fixing block assembly, generally designated 66, this assembly being supported on the framework 40 on the side adjacent the patient's head, at about the middle of plate 50.

Referring now to FIG. 3, the traction weight assembly 60 has been removed for the purpose of discussion. As shown, the framework 40 has first and second generally L-shaped blocks 42 and 44 configured for securing to the support plate 18 by any convenient means such as a bolted handle 68 (see FIG. 1). Support plate 18 is secured in a perpendicular relationship to platform 10 in any convenient manner providing sufficient rigidity and strength. Affixed to the free ends of portions 42*a* and 44*a* are generally perpendicularly extending rod members 46 and 49, the upper ends of which pass through apertures in the top plate 50, these upper ends being suitably threaded for attaching fasteners to opposite sides of the plate 50 for securing. The short leg portions 42*b* and 44*b* have apertures therein for threadably receiving the first, or lower ends of rods 47 and 48, which are threaded through the mid-range thereof, and at the upper ends, where the rods 47 and 48 pass through apertures in the corners with nuts on either side thereof being threaded on the rods 47 and 48 for securing the top plate 50 in position. As such, the top plate 50 is parallel to the plane of the platform 10. The rods 46–49 are formed of metal such as steel or aluminum, and likewise, the plate 50 is formed of a structural material, such as steel or aluminum, the reasons for which will be discussed hereafter.

The rearmost rods 47 and 48 support, in part, the main pulley block assembly 54 which includes a generally rectangular block member 54*a* having slots 54*b* and 54*c* cut in opposite ends thereof for having rotatably mounted therein the main pulleys 56 and 58, respectively. The rear end of block 54*a* has a first and second shaft members 70 and 72 passing through apertures formed therein in the direction of the axle of the pulley 56. The block 54*a* is thus slidable on the shafts 70 and 72. The shafts 70 and 72 are generally parallel with the terminal ends thereof being secured to opposing main pulley support blocks 74 and 76 which have apertures extending therethrough in an orthogonal direction for assembly on the rods 47 and 48 respectively. The apertures in blocks 74 and 76 are larger in diameter than the diameter of rods 47 and 48 for providing slidable movement therebetween, with the blocks 74 and 76 being secured in the desired position by tightening of suitable locknuts 78 and 80 threadably received on rods 47 and 48 respectively. There are also similar locknuts beneath the blocks 74 and 76 as would be obvious.

Since the main pulley block assembly is supporting the traction weight and projects out from the shafts 70 and 72 additional support is provided by means of an adjustable support rod 84 which has a knob 86 at the upper end thereof, the rod 84 passing down through a suitable opening in the housing of the auxiliary pulley assembly 52 and then through a threaded aperture in main pulley block 54*a* just behind pulley 58. The adjusting rod 84 is thus parallel to rods 47 and 48 thus providing three points of support for the main pulley block assembly 54. During vertical adjustment of the main pulley block assembly 54, both locknuts 78 and 80 are adjusted along with adjusting rod 84 to maintain block 54*a* generally parallel to platform 10. As shown in FIG. 3 by the arrows adjacent block 54*a*, it may be adjusted up or down as well as from side to side, this lateral movement being effected by locknuts (not shown) on one of the shafts 70 or 72 which would be suitably threaded at about the midrange thereof to accommodate the nuts. After adjustment, the nuts would be suitably tightened to maintain the adjusted position.

The auxiliary pulley assembly 52 includes a pulley housing 52*a* having rotatably mounted therein four pulleys 90–93 (see also FIG. 7), the housing 52*a* being assembled on top plate 50 at about the center thereof in generally parallel relation to the main pulley block 54*a*. Although top plate 50 is a substantially imperforate member, it is to be understood that there would be holes therethrough in proximate relation to the pulleys 90–93 as required, for passage therethrough of the traction cord to be described. The auxiliary pulley assembly may be attached to top plate 50 in any convenient manner, such as bolts or by welding. Also, if desired, pulleys 90 and 91 could be replaced with one pulley and likewise pulleys 92 and 93.

The fixing block assembly 66 is likewise secured to the top plate 50, and is adjustable in a vertical direction. Referring specifically to FIGS. 3 and 7, the fixing block 66 is formed of two blocks 66*a* and 66*b*, assembled one on top the other and secured to each other. The upper block 66*a* has an opening cut therethrough for rotatably receiving the fixing block pulley 96, with the lower block 66*b* having an aperture 98 therethrough in a downward direction just below the pulley 96. Rearwardly of pulley 96 the block 66 has a threaded aperture therein for receiving an adjustment shaft 100, the shaft 100 being threaded with the upper end thereof passing through a suitable opening in the housing 52*a* of the auxiliary pulley assembly 52 and terminating in a knob 102. Rotation of knob 102 effects vertical travel of the fixing block 66 as required. In order to assist in the support of fixing block 66 and to prevent rotation thereof, a guide rod 104 is secured at the upper end thereof to the plate 50 with the rod 104 extending parallel to adjusting shaft 100 and through a suitable opening in the block 66 at a point opposite the threaded aperture through which shaft 100 passes.

Figure 4:
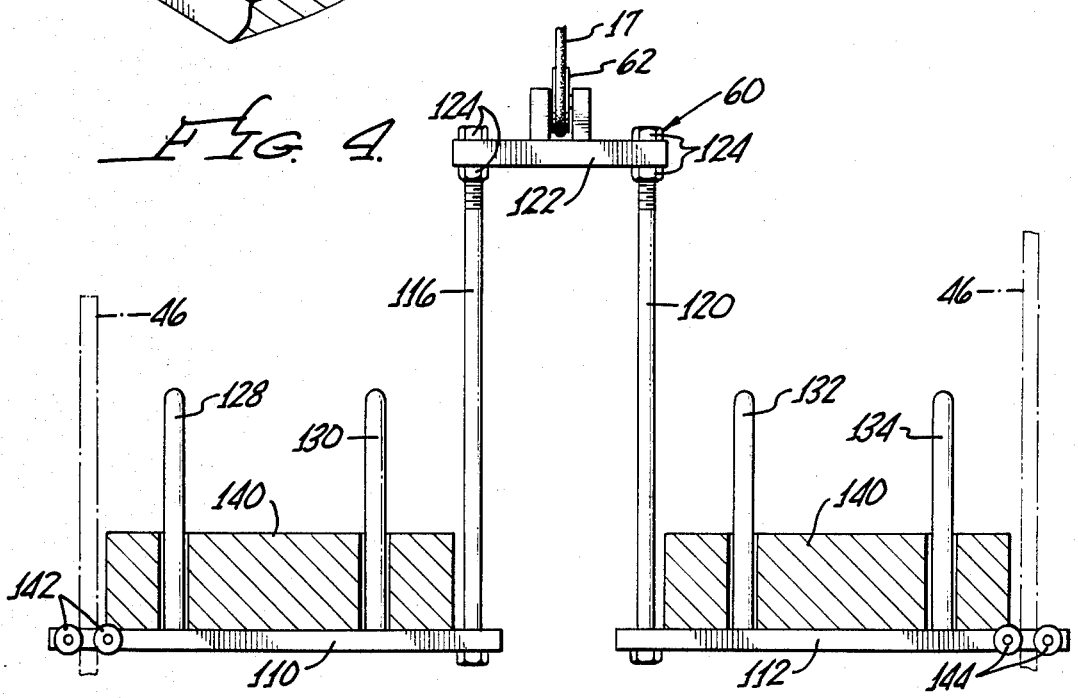
FIG. 4 is a front view of the traction weight carrier assembly illustrating weights thereon in cross-section.

Referring now specifically to FIG. 4, and generally to FIG. 2, the traction weight carrier assembly 60 will be described. The assembly 60 includes split weight carrying means in the form of first and second generally plate-shaped members 110 and 112 arranged in coplanar relation, the two plate members being generally identical. At the proximate ends thereof there are secured a pair of upwardly extending rod members 114 and 116 (to plate 110) and 118 and 120 (to plate 112) the rods being in generally parallel relation and of the same height. At the upper ends thereof, the rods are fastened to a traction pulley block 122 by a convenient method such as nuts 124 threaded on the ends of the rods on either side of openings through which the rods pass through block 122. The traction pulley block 122 is parallel to weight plate members 110 and 112. Positioned centrally on block 122 and secured thereto is the traction pulley 62.

Extending upwardly from the surfaces of plate-shaped members 110 and 112 are aligning rods such as rods 128 and 130 on member 110 and rods 132 and 134 on member 112. The rods 128, 130, 132 and 134 are arranged for receiving thereover suitable traction weights 140 which are provided with holes extending therethrough to prevent dislodgement. To promote easy movement and alignment of the traction weight assembly 60, alignment wheels 142 and 144 are rotatably attached to the forward edges of the plate-shaped weight carrying members 110 and 112 respectively, at locations where, as can be seen in FIG. 2, the alignment wheels are attached about the rods 46 and 49 to control movement of the traction weight assembly in a direction parallel to rods 46 and 49.

Referring now specifically to FIG. 7, and generally to FIGS. 1, 2 and 8, the arrangement of the cord 17 relative to the pulleys will be described. The cord 17 is secured to the S-hook 16 which is attached to the traction bracket or tongs 14. The cord 17 then passes directly away from the head of the patient 12 over main pulley 56 and then upwardly to pass over auxiliary pulleys 90 and 91. Cord 17 is then threaded downwards and about pulley 62 (shown in dotted lines, this being part of the traction weight assembly 60) and then upwards about the remaining auxiliary pulleys 92 and 93. The auxiliary pulleys 90–93 serve the function of redirection of the force to provide compactness. The cord 17 is then directed downward over fixing block pulley 96 where it is then fed through aperture 98 in the fixing block 66, the free end of cord 17 then being secured to a retaining ring 19, the ring 19 being of a larger diameter than aperture 98 to prevent passing therethrough. The purpose of ring 19 is twofold, one purpose being to fix the position of the weight arrangement of the portable traction unit by adjusting the fixing block downwardly until the ring 19 abuts the bottom of fixing block 66, and the other purpose being to serve as an assist in transferring from the conventional traction arrangement to the portable traction arrangement and vice versa.

Prior to discussing the transfer from one traction arrangement to the other, attention is directed to the support framework 40 and weight carrying assembly 60 by particular reference to FIGS. 2 and 4. Ordinarily, with the patient 12 on the platform 10, and the platform 10 secured to a turning frame, the portable traction unit 36 would not be present. The patient would have conventional traction applied, which simply means that the S-hook 16 would be attached to a cord, such as cord 180 in FIG. 8, the cord 180 simply passing over a fixed pulley 182 and attached at the other end thereof to a traction weight 184, which would be somewhat freely suspended to act under the force of gravity during the turning process. As can be seen in FIGS. 2 and 4, the framework 40 and the traction weight carrying assembly 60 are configured to "straddle" the cord 180 of the conventional traction arrangement. In this way, while the patient 12 is still under conventional traction, the framework 40 can be secured to the platform 10 without disturbing the existing traction.

Once the portable traction unit 36 is secured to the platform 10, the changeover can be effected. Referring to the diagrammatic illustration of FIG. 8, the cord and various pulleys and weights are shown without regard to the supporting structure to facilitate the description. The pulleys bear the same reference numerals as the corresponding pulleys in the other views, and are positioned in corresponding relation. Of the structural members, only the fixing block 66 is shown, in dotted lines. Similarly, the traction tongs are omitted along with the patient, it being understood that the patient's head will be to the right of the S-hook 16, as viewed in FIG. 8.

Figure 8:
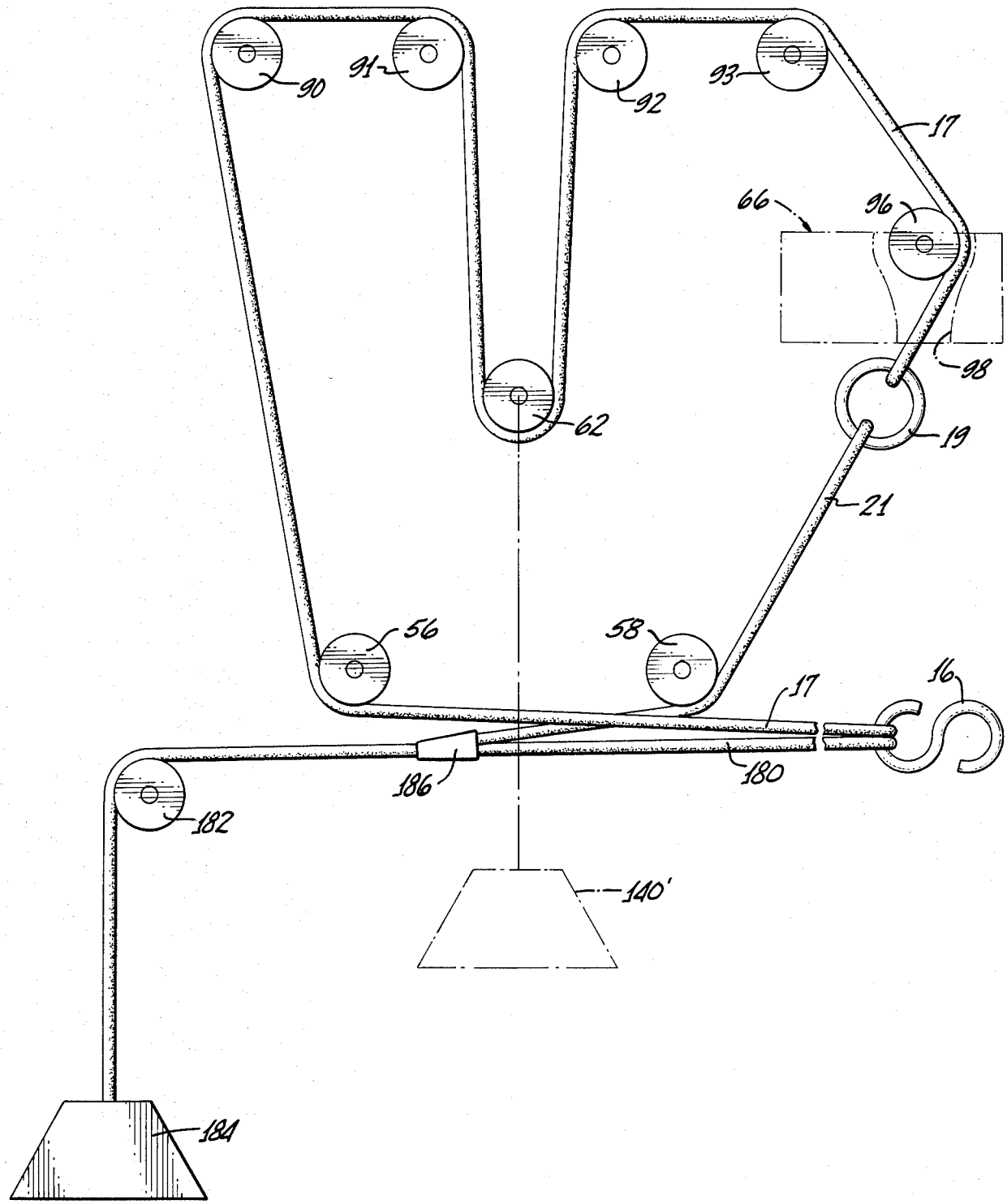
FIG. 8 is a diagrammatic view of the cord and pulley arrangement of the apparatus along with the cord and pulley arrangement of the conventional traction system.

Essentially, as previously described, the conventional traction arrangement will include the S-hook 16 attached to the traction tongs with the cord 180 pulling in the desired direction for maintaining cervical traction, this direction being to the left as viewed in FIG. 8 from whence the cord 180 passes over a suitable pulley arrangement 182 where it is redirected downwardly by a traction weight 184. The pulley 182 is secured to some fixed point relative to the patient. In a turning table, the cord 180 passes through a tubular member at the axis of rotation of the table with the weight 184 being freely suspended in air. Once the portable traction unit 36 is secured to the platform 10, the changeover can be effected.

By reference to FIG. 8, the end of cord 17 is attached to the S-hook 16 (or alternatively a second S-hook is attached to the tongs 14) and with the cord fed over the various pulleys as previously described, a supplemental cord 21 is attached to the retaining ring 19. The cord 21 is then directed to the left as viewed in FIG. 8, that is, in the direction of the fixed pulley 182 of the conventional traction arrangement, at which point the free end of supplemental cord 21 is attached to conventional traction cord 180 at point 186, and tension is applied by allowing weight 140' (a diagrammatic representation of the combined weights 140 on carrier assembly 60) to hang free. This attachment of the supplemental cord 21 may be by any convenient means such as a clamp, since the attachment is only temporary. At this time, although there is a downward force exerted on traction weight pulley 62 which places the cord 17 under tension, the cord 17 at the point of attachment to S-hook 16 is exerting a force to the left, while the supplemental cord 21 at the point of attachment to the cord 180 is exerting a force to the right on cord 180, these forces being equal and opposite and thus cancelling each other. In effect, the S-hook 16 now feels only the force of the cord 17. With the cord 17 thus tensioned, and the portable traction weight 140' hanging free, the retaining ring 19 lies along a line below the fixing block 66.

By referring also to FIGS. 2 and 3, the fixing block 66 is then adjusted downwardly by rotation of the fixing block adjusting knob 102 which turns shaft 100 to vertically move block 66. Block 66 is moved down until the ring 19 is contacted and urged downwardly by the fixing block 66. At this time any other adjustments can be effected, such as adjustment of the main pulley block **54*a* as needed vertically, or laterally to maintain the direction of traction for the portable unit consistent with the fixed traction arrangement. After all adjustments are made, all locknuts are secured to maintain the parts of the portable traction unit 36** in position.

Then, the conventional traction arrangement can be removed. This is done by removing the traction weight 184 and cord 180 along with undoing the attachment at point 186 of the supplemental cord 121. In order to maintain the same force of traction on the patient, the traction weight 140' must be approximately twice the weight of the conventional traction weight 184. Since the force of traction applied by weight 184 is equivalent to the weight thereof, and since weight 140' is supported by two ropes instead of one, by fundamentals of physics, the weight 140' has to be, in total (including the weight of the weight carrier assembly 60) double the original weight. Furthermore, as previously described, since the portable traction unit weight carrier assembly 60 is bifurcated or split to provide access thereunder, the cord 180 of the conventional traction arrangement is not interfered with or contacted during assembly of the portable traction unit 36.

Once the conventional weight 184 and cord 180 is removed, the platform 10 may be separated from the turning table for transport of the patient 12 to a C.T.scan unit for further diagnosis. Such a diagnostic unit has an opening of approximately two feet diameter through which the patient and platform 10 may pass. The patient and platform are supported on the scanner table, which is essentially two tables, one on either side of the opening. The head end of the platform 10 is provided with rollers 30 which engage the surface of one of these tables. During the scanning process, after each scan, the patient is advanced an increment for the next scan, with the rollers 30 simplifying this movement. Although the portable traction unit, and support plate 18 are largely metallic, these metallic areas are outside the scanner opening and do not interfere with the results. This is particularly so with the platform 10 being formed of a radiolucent material such as wood. The overall dimensions of the portable traction unit 36 are such that the combined platform 10 and traction unit 36 pass very readily through the scanner opening, and during the entire time the diagnostics are performed, the patient is in cervical traction. The opening of the hyperbaric chamber generally corresponds to the diameter of the scanner, or somewhat larger, and consequently the dimensions of the portable traction unit 36 permit use in such chambers. Once treatment or diagnosis is accomplished, and it is desired to return the patient to the turning table, the platform 10 simply has the mounting block 20 thereof attached to the turning table with the platform 10 then being secured. The reverse of the procedure described with reference to FIG. 8 is performed, that is, the conventional traction is applied by means of reconnection of cord 180 and weight 184. Once attached, fixing block 66 is adjusted in the reverse direction to lower weight 140', and then the portable traction unit 36 may be conveniently removed.

In accordance with the present invention, unnecessary patient handling is eliminated. Further, risk of aggravation of existing cervical trauma is minimized or eliminated by avoiding the manual traction procedure formerly employed when transferring the patient from the turning table. In addition, by eliminating the current metallic tubular platform currently used and utilizing the platform of the instant invention cervical traction and alignment can be constantly maintained while treating the patient, at significantly reduced risk. While there has been shown and described a preferred embodiment, it is to be understood that various other adaptations and modifications may be made without departing from the spirit and scope of the invention.

I claim:

1. Cervical traction apparatus usable with a turning frame while providing transport of the patient for other treatment and diagnosis while maintaining traction, said apparatus comprising:

a generally planar, generally rigid platform of radiolucent material for receiving the patient thereon:

means on said platform for enabling the attachment thereof to a turning frame with other traction apparatus;

portable traction means mountable on said platform between the head of the patient and the adjacent end of said platform, said traction means including:

(a) a supporting framework configured for attachment to said platform without interfering with the other traction apparatus;

(b) pulley means attached to said framework;

(c) weight carrying means mounted on said framework and being configured and arranged for non-interference with the other traction apparatus, said weight carrying means being movable relative to said framework and including a pair of coplanar plate members in spaced relation with the spacing therebetween sufficient for straddling the cord of the other traction apparatus;

(d) cord means coacting with said pulley means and said weight carrying means, one end of said cord means being attachable to the traction bracket of the other traction apparatus; and (e) fixing means for securing the other end of said cord means with said weight carrying means applying tension to said cord means and for enabling the removal of the other traction apparatus whereby said platform can be transported under traction provided by said portable traction means.

2. The combination according to claim 1 wherein said apparatus further includes means for adjusting at least some of said pulley means.

3. The combination according to claim 1 wherein said weight carrying means includes at least one pulley.

4. The combination according to claim 1 wherein said weight carrying means includes a generally centrally disposed block member, and means for suspending said plate members therefrom.

5. The combination according to claim 4 wherein said weight carrying means further includes at least one pulley mounted on said block member for coacting with said cord means.

6. The combination according to claim 5 wherein said cord means is a cord.

7. The combination according to claim 6 wherein said fixing means includes a fixing block having a pulley rotatably mounted thereon and an aperture therein for passage therethrough of the other end of said cord, and means on said other end for retaining said cord to prevent passage through said aperture.

8. The combination according to claim 7 wherein said fixing means includes means for vertically adjusting the position of said fixing block for applying tension to said means for retaining said cord.

9. The combination according to claim 5 wherein said weight carrying means further includes guide means coacting with said framework for controlling the direction of movement of said weight carrying means.

10. The combination according to claim 9 wherein said framework includes at least a pair of vertically extending rod members and said guides means are wheel means rollingly engaging said rod members.

11. The combination according to claim 10 wherein said frame work includes a top plate member, some of said pulley means is an auxiliary pulley block assembly mounted on said top plate member, and said cord means coacts with the pulleys of said pulley block assembly.

12. The combination according to claim 11 wherein said pulley means also includes a main pulley block assembly having at least one pulley thereon over which the cord means passes from the traction bracket means of the conventional traction apparatus.

13. The combination according to claim 11 wherein said main pulley block assembly is mounted to said framework for enabling vertical adjustment thereof.

14. The combination according to claim 13 wherein the pulley of said weight carrying means is physically above said main pulley block assembly.

15. In an apparatus for attachment to a patient carrying device for applying traction while said patient carrying device is being used for transporting a patient, and for enabling transfer to or from other traction apparatus the combination comprising:

a framework having means for attachment to the device adjacent the head end thereof;

pulley means adjacent the upper end of said framework;

weight carrying means movably mounted to said framework adjacent the lower end thereof, said weight carrying means including first and second aligned spaced weight carrying members commonly movable in spaced relation so as to straddle the cord of the other traction apparatus, said weight carrying means further including at least one pulley member;

other pulley means mounted to said framework for vertical adjustment relative thereto;

a cord member coacting with said other pulley means, said at least one pulley member and said pulley means adjacent the upper end of said framework, one end of said cord member being attachable to traction bracket means configured for engaging the patient; and means fixing the position of the other end of said cord member with said weight carrying means acting under the force of gravity, the coaction of said cord member with the pulley arrangement being such as to apply traction to the patient.

16. The combination according to claim 15 wherein said weight carrying means includes means coacting with said framework for guiding the movement of said weight carrying means.

17. The combination according to claim 15 wherein said first and second spaced members are coplanar weight carrying plate members coupled to an upwardly disposed generally central block member having said plate members attached thereto in suspended relation.

18. The combination according to claim 15 wherein said framework and said weight carrying means include coacting guide means for controlling the direction of movement of said weight carrying means.

19. Portable traction apparatus attachable to a platform having thereon a patient in other traction with traction bracket means attached to the patient with a cord directed from the traction bracket means over pulley means to another traction weight, said apparatus comprising:

a framework configured for attachment to said platform intermediate the patient's head and the adjacent end of said platform, said framework being configured for straddling the cord of the other traction apparatus so as not to interfere therewith;

weight carrying means movably coupled to said framework, said weight carrying means having a weight carrying portion configured for straddling the cord of the other traction apparatus so as not to interfere therewith, said weight carrying portion including a pair of coplanar weight carrying plate members in spaced relation and an upwardly disposed generally central block member having said plate members attached thereto in suspended relation;

pulley means on said framework;

a cord member operatively coupled to said pulley means and said weight carrying means, said cord member having one end thereof attachable to said traction bracket means; and means for fixing the position of the other end of said cord member relative to said framework for enabling the application of tension to said cord member while enabling the removal of the other traction apparatus without losing traction on the patient.

20. The combination according to claim 19 wherein said block member of said weight carrying means has at least one pulley attached thereto.

21. The combination according to claim 20 wherein said framework includes a top plate member, and said pulley means includes a pulley block assembly attached thereto and a main pulley block assembly attached to said framework with the pulleys thereof below said weight carrying means pulley.

22. The combination according to claim 21 wherein said fixing means includes a fixing block having a pulley thereon and an aperture therein for passage therethrough of the other end of said cord member, and means on said other end of said cord member for retaining said cord member to prevent passage through said aperture.

23. Portable traction apparatus attachable to a platform having thereon a patient in other traction with traction bracket means attached to the patient with a cord directed from the traction bracket means over pulley means to a traction weight, said apparatus comprising:

a framework configured for attachment to said platform intermediate the patient's head and the adjacent end of said platform, said framework having at least one pair of generally parallel rod members and being configured for straddling the cord of the other traction apparatus so as not to interfere therewith;

weight carrying means movably coupled to said framework, said weight carrying means having a weight carrying portion configured for straddling the cord of the other traction apparatus so as not to interfere therewith, said weight carrying means including guide means coacting with said rod members for controlling the direction of movement of said weight carrying means;

pulley means on said framework;

a cord member operatively coupled to said pulley means and said weight carrying means, said cord member having one end thereof attachable to said traction bracket means; and means for fixing the position of the other end of said cord member relative to said framework for enabling the application of tension to said cord member while enabling the removal of the other traction apparatus without losing traction on the patient.

24. The combination according to claim 23 wherein at least some of said pulley means are adjustably positionable relative to said framework.

25. The combination according to claim 23 wherein said fixing means includes a fixing block assembly having a fixing block with a pulley thereon for passage thereover of the other end of said cord member and an aperture through which the cord member passes, the free end of the cord member having a retaining ring attached thereto, said fixing block being vertically adjustable for applying tension to said cord member by urging against said retaining ring against the force of the weight of said weight carrying means.

* * * * *